US005107568A

United States Patent [19]

Wade

[11] Patent Number: 5,107,568

[45] Date of Patent: Apr. 28, 1992

[54] DUCT SWEEPER

[75] Inventor: Calvin N. Wade, Hico, Tex.

[73] Assignee: Steamatic, Inc., Grand Prairie, Tex.

[21] Appl. No.: 671,710

[22] PCT Filed: May 22, 1990

[86] PCT No.: PCT/US90/02861

§ 371 Date: Apr. 3, 1991

§ 102(e) Date: Apr. 3, 1991

Related U.S. Application Data

[63] Continuation of Ser. No. 407,348, Sep. 14, 1989, Pat. No. 4,984,329.

[51] Int. Cl.[5] ..... A47L 5/36

[52] U.S. Cl. ..... 15/387; 15/395

[58] Field of Search ..... 15/387, 395, 383

[56] References Cited

U.S. PATENT DOCUMENTS

| | | | |
|---|---|---|---|
| 1,580,294 | 4/1926 | Gawley | 15/387 X |
| 2,078,634 | 4/1937 | Karlstrom | 15/387 X |
| 2,351,169 | 6/1944 | Weinland | 15/387 X |
| 4,792,363 | 12/1988 | Franklin et al. | 15/395 X |
| 4,800,616 | 1/1989 | Wade | 15/387 X |

FOREIGN PATENT DOCUMENTS

| | | | |
|---|---|---|---|
| 2064410 | 7/1971 | Fed. Rep. of Germany | 15/387 |
| 340683 | 5/1904 | France | 15/387 |
| WO85/02991 | 7/1985 | PCT Int'l Appl. | 15/387 |

*Primary Examiner*—Chris K. Moore
*Attorney, Agent, or Firm*—Arthur F. Zobal

[57] ABSTRACT

The cleaning apparatus in one embodiment is formed by a housing member having a first flexible hose coupled to a first end and a smaller diameter second flexible hose coupled to a second opposite end. A turbine is supported for rotation within the housing member. A flexible drive shaft extends through the second flexible hose and has one end coupled to the turbine for rotation therewith and a second end extending out of the other end of the second flexible hose with a brush coupled thereto. An air blower, which preferably is operated in the vacuum mode, is coupled to the first flexible hose for moving air through the second flexible hose, the housing member, and the first flexible hose for causing the turbine and hence the flexible drive shaft and brush to rotate for cleaning the wall of an air duct with the brush and for removing dust and other matter from the duct. In another embodiment of the apparatus, a separate air motor is employed to rotate the flexible drive shaft and hence the brush.

13 Claims, 3 Drawing Sheets

213
29
219
217
201
203
35
205
283
285
181
51
41
43
45B
35B
43
45

215
271
275
277
279
281
273
43A 213
217
225
223
201
215
241
231A
233
43
231
203B
251
263
207
35A
203AE
203A
203
231B
203BE
45A
261

DUCT SWEEPER

This application is a continuation in part of U.S. patent application Ser. No. 07/407,348 filed on Sep. 14, 1989, and now U.S. Pat. No. 4,984,329, issued Jan. 15, 1991.

BACKGROUND OF THE INVENTION

1. Field of the Invention

The invention relates to a cleaning apparatus for cleaning air ducts in houses or buildings.

2. Description of the Prior Art

U.S. Pat. Nos. 1580294, 2078634, and 4800616 disclose air powered cleaning devices comprising a hose having a turbine attached thereto which is rotated by air for rotating a brush or other device for cleaning purposes. Netherlands patent No. 676.188 discloses a cleaning brush driven by an electric motor with a vacuum attachment.

SUMMARY OF THE INVENTION

It is an object of the invention to provide a cleaning apparatus which allows the thorough, yet gentle cleaning of small and/or fragile ducts in homes or buildings.

The apparatus comprises a flexible hose means having first and second ends with the second end being insertable into a duct for cleaning purposes. The flexible hose means provides an air flow path between said first and second ends. Drive means is provided having a rotatable shaft means. A flexible drive shaft extending at least partially through said flexible hose means has a first end coupled to said shaft means and a second end extending out of said second end of said flexible hose means for rotation with said shaft means. Brush means is coupled to said second end of said flexible drive shaft for rotation therewith for cleaning the wall of the air duct upon rotation of said flexible drive shaft.

In a further aspect, means coupled to said first end of said flexible hose means is provided for reducing the pressure within said flexible hose means for causing air to flow through said flexible hose means for removing dust and other material loosened in the air duct by said brush means.

In another aspect, the drive means is operated by air for rotating said shaft means.

In one embodiment a separate air source is provided for operating said drive means. In this embodiment, a tubular support member is coupled to said first end of said flexible hose means and said drive means is mounted to said tubular support member. The flexible drive shaft extends from said shaft means through the wall of said tubular support member to the interior of said flexible hose means.

DETAILED DESCRIPTION OF THE PREFERRED EMBODIMENTS

Figure 1:
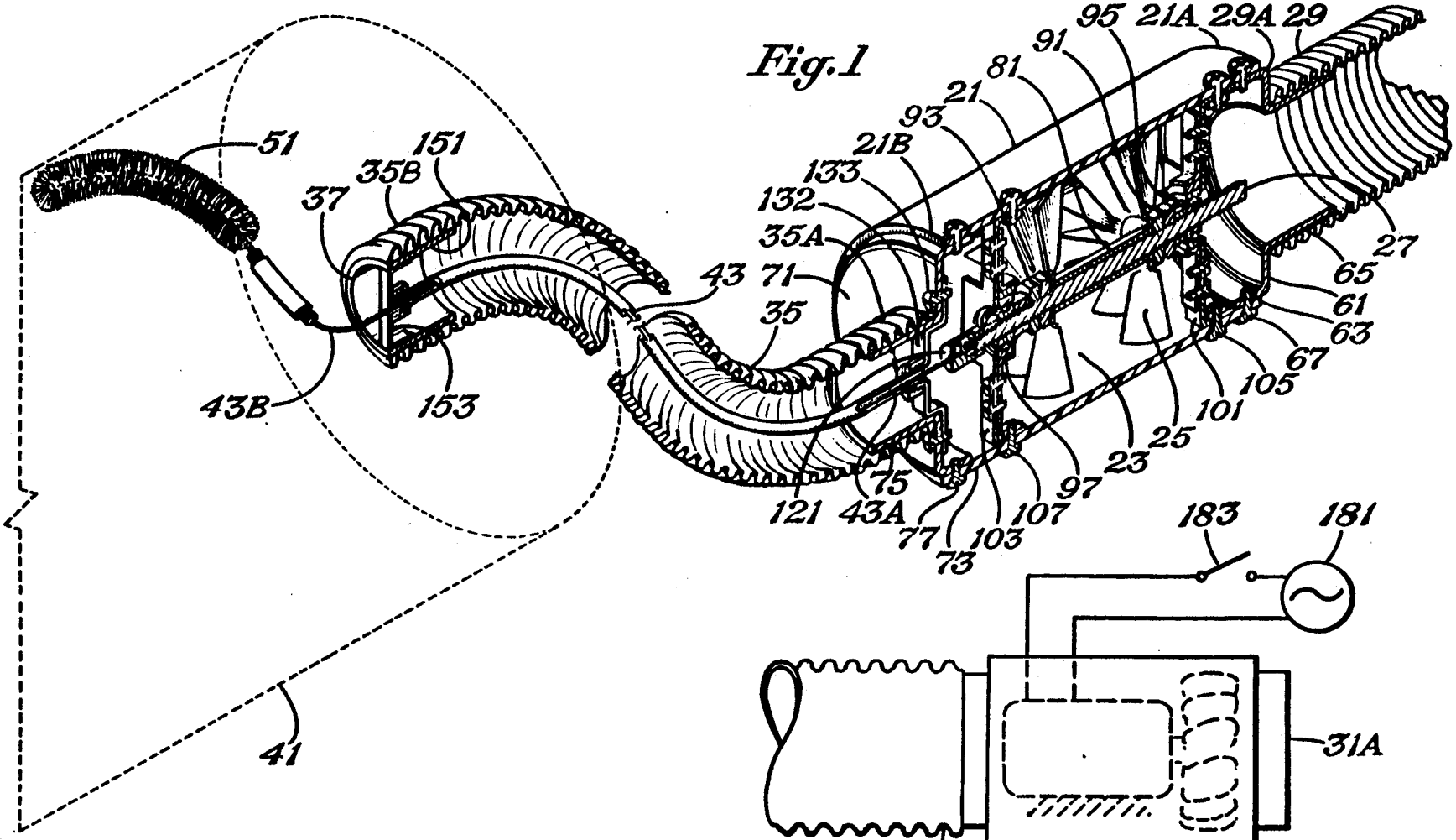
FIG. 1 is a cross-sectional view of components of one embodiment of the invention.
Figure 2:
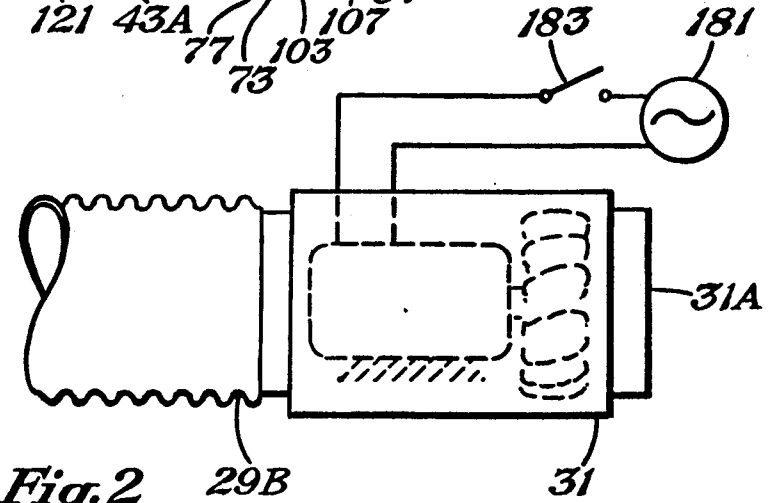
FIG. 2 illustrates a blower coupled to the larger hose of the apparatus of FIG. 1.

Referring to FIGS. 1-5 of the drawings, the cleaning apparatus comprises a housing 21 which supports a turbine 23 for rotation. The turbine 23 comprises blades 25 attached to a shaft 27 which are supported for rotation in the housing 21. A flexible hose 29 has an end 29A coupled to the end 21A of the housing 21 and an end 29B coupled to a blower 31. A smaller diameter flexible hose 35 has an end 35A coupled to the end 21B of the housing 21 and a free end 35B adapted to be located in an air duct 41 for cleaning purposes. A flexible drive shaft 43 has an end 43A connected to the drive shaft 27 a rotation therewith. The drive shaft 43 extends through the hose 35 and projects beyond its free end 35B. A brush 51 is connected to the free end 43B of the drive shaft. In the preferred operation, the end 35B of the smaller diameter hose 35 and the brush 51 are inserted into the conduit 4I and the blower 31 is operated as a vacuum blower to move air from the air duct 41 by way of a flow path through the flexible hose 35, the housing 21, and the flexible hose 29. This causes the turbine 23 to rotate which in turn causes the flexible drive shaft 43 and the brush 51 to rotate. Rotations of the brush 51 in the air duct 41 causes the brush 51 to move outward by centrifugal force to make contact with all sides of the duct 41 to loosen matter and dust from the inside wall of the air duct 41. The loosened material is removed by the vacuum and out of the exit 31A of the blower 31 by way of the entrance 37 to the flexible hose 35, through the flexible hose 35, through the housing 21, and through the flexible hose 29. Thus the brush 51 is driven by the turbine 23 that is powered by the vacuum. Rotary power is transmitted by the flexible drive shaft 43 between the turbine 23 and the brush 51. This system allows the thorough, yet gentle cleaning of small and/or fragile ducts. Since the flexible hose 35 is small in diameter, it may be readily inserted into small air ducts or into small register or vent openings into an air duct and moved into the air duct for cleaning purposes by operating the blower for rotating the turbine and hence the flexible drive 43 and the brush 51. The flexible hose 35 can readily turn elbows in the air duct 41 and the brush 51 in effect sweeps the inside of the walls of the duct 41 without any damage occurring thereto.

In the embodiment disclosed, the housing 21 comprises a hollow cylindrical member having two end walls 61 and 71. End wall 61 joins two tubular portions 63 and 65 of greater and smaller diameters respectively. Tubular portion 63 fits inside of the housing end 21A and is secured thereto by bolts 67. The end 29A of flexible hose 21 tightly fits around tubular portion 63. End wall 71 joins two tubular portions 73 and 75 of greater and smaller diameters respectively. Tubular portion 73 fits inside of the housing end 21B and is secured thereto by bolts 77. The end 35A of hose 35 tightly fits around tubular portion 75.

The turbine 23 comprises two sets of blades or vanes 25 secured to a tubular member 81 which is secured to the shaft 27 by nuts 91 and 93 for rotation therewith. The shaft 27 is supported for rotation inside of the housing 21 by bearings 95 and 97 which are supported by support members 101 and 103 which are secured to the inside of the housing 21 by bolts 105 and 107.

Figure 3:
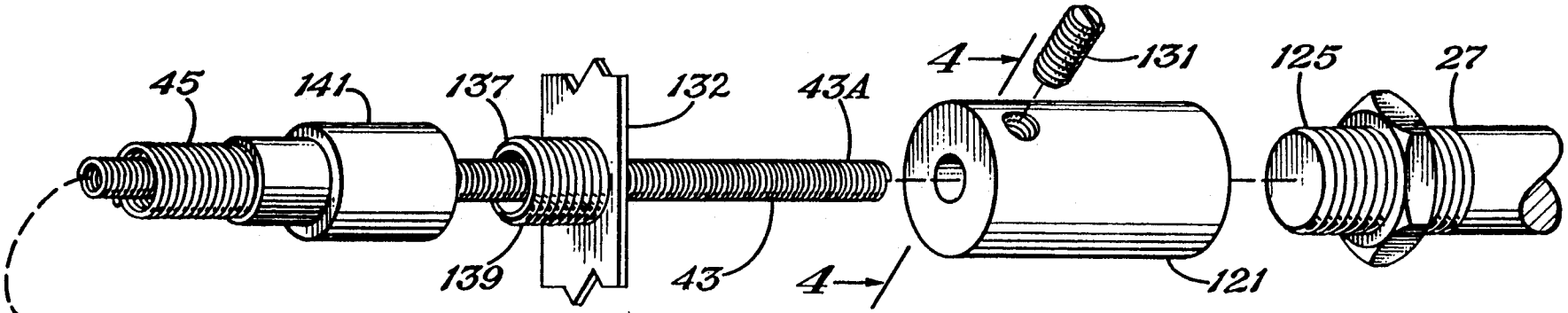
FIG. 3 is an exploded view of the mechanism for coupling the flexible drive shaft and its sleeve to the turbine shaft and to structure of the apparatus of FIG. 1.
Figure 3:
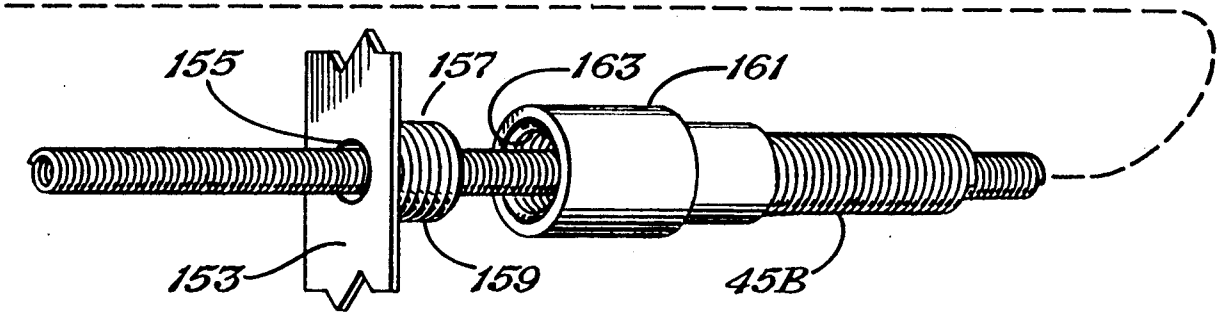
Figure 4:
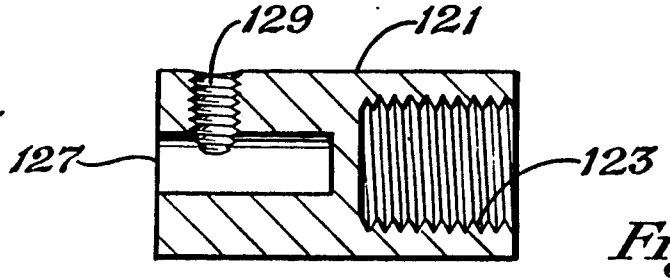
FIG. 4 is a cross-sectional view of a coupling means of FIG. 3 for coupling the flexible drive shaft to the turbine shaft.
Figure 5:
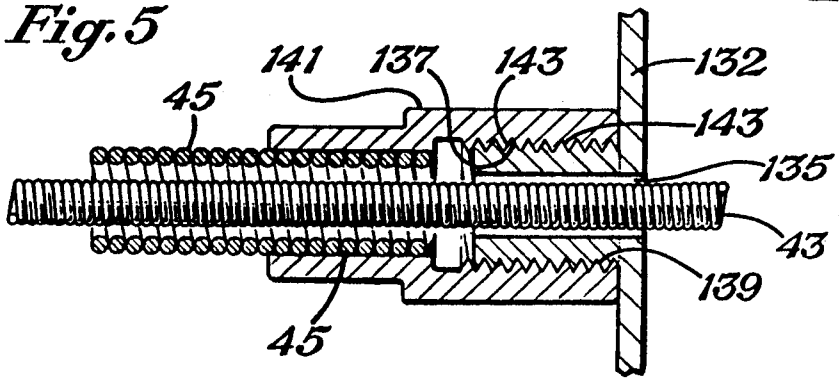
FIG. 5 is a cross-sectional view of the coupling means of FIG. 3 for coupling the flexible drive shaft sleeve to structure of the turbine housing.

The flexible drive shaft 43 is secured to the shaft 27 by a coupling member 121. As shown in FIGS. 3 and 4, coupling member 121 has a threaded aperture 123 formed at one end which is screwed to threads 125 formed on the end of shaft 27. The other end of the couping member 121 has a central aperture 127 for receiving the end 43A of the flexible drive shaft 43 and a threaded hole 129 in which a set screw 131 is screwed for securing the drive shaft 43 to the coupling member 121 for rotation with the turbine shaft 27.

The flexible drive shaft 43 has an outer flexible sleeve 45 which has an end 45A that is coupled to the end wall 71 in a manner to prevent rotation of the sleeve 45. A support member 132 is secured to the end wall 71 by bolts 133. The support member 132 has an aperture 135 formed therethrough for freely receiving the flexible drive shaft 43. A tubular member 137 is secured to the outside of the support member 132 around the aperture 135 for freely receiving the flexible drive shaft 43. Threads 139 are formed on the outside of tubular member 137. The end 45A of the flexible sleeve 45 is fixedly secured to a tubular member 141 which has a threaded aperture 143 at an end thereof which is screwed to the tubular member 137.

The free end 35B of the flexible hose 35 has a tubular member 151 fitted on the inside thereof to Which a support member 153 is secured by bolts (not shown). The support member 153 has an aperture 155 formed therethrough for freely receiving the end 43B of the flexible drive shaft 43. A tubular member 157 is secured to the inside of the support member 153 around the aperture 155 for freely receiving the end 43B of the flexible drive shaft 43. Threads 159 are formed on the outside of the tubular member 157. The end 45B of the flexible sleeve 45 is fixedly secured to a tubular member 161 which has a threaded opening 163 formed at an end thereof which is screwed to the tubular member 157. The tubular member 161 freely receives the end 43B of the flexible drive shaft 43.

In one embodiment, the housing member 21 may have an outside diameter of about 3¼ inches and a length of about 9¾ inches. The walls 21, 61 and 71 of the housing member 21 may be formed of metal or suitable plastic. The components of the turbine 23 may be formed of metal. The flexible hoses 29 and 35 may be conventional flexible hose formed of corrugated flexible plastic in which is embedded a helically coiled wire for support purposes. Hose 29 may have an inside diameter of 2 inches and a length of 50–150 feet. The hose 35 may have an inside diameter of 1½ inches and a length of 10–15 feet. The flexible drive shaft 43 and its outer sleeves 45 may be a conventional flexible drive shaft assembly formed of suitable coiled wires.

The flexible hose 35 may be used to clean round or even square ducts into which the housing 21 and hose 29 cannot fit. A conventional round duct which may be cleaned with the apparatus may have an inside diameter of from 2 to 10 inches. Due to the elbows such a duct may have, the housing 21 may not pass therethrough, however, since the hose 35 has essentially no rigid restrictions and is flexible between its ends 35B and 35A, it can readily pass all elbows of the air duct. The length of the tubular member 151 can be made shorter than that shown, if desired, in order to minimize it affect on the flexibility of the hose 35 at the hose end 35B. The hose 35 also can readily pass through small register or vent openings. The hose 35 and brush 51 also can be used to effectively clean fragile air ducts without damage to the duct. Such fragile air ducts now on the market comprise a plastic inner liner with insulation on the outside.

It is desirable that the hose 29 have a relatively large inside diameter in order to minimize the air resistance to obtain a high turbine rpm.

The vacuum blower 31 may comprise plurality of electric motors having a total house power of 7½ capable of drawing 40 amps and with fan blades capable of moving 300 cfm of air. The electric motors are operated from an AC power source 181 when the switch 183 is closed. The blower 31 may be operated as a vacuum blower or reversed to blow air through hose 29 housing 21 and hose 35. The blower 31 is not shown to scale and will be much larger than shown compared to the diameters of hose 29 and housing member 21. It is to be understood that the apparatus of the embodiment of FIGS. 1–5 may have other dimensions and operating specifications.

Figures 6, 7, 8:
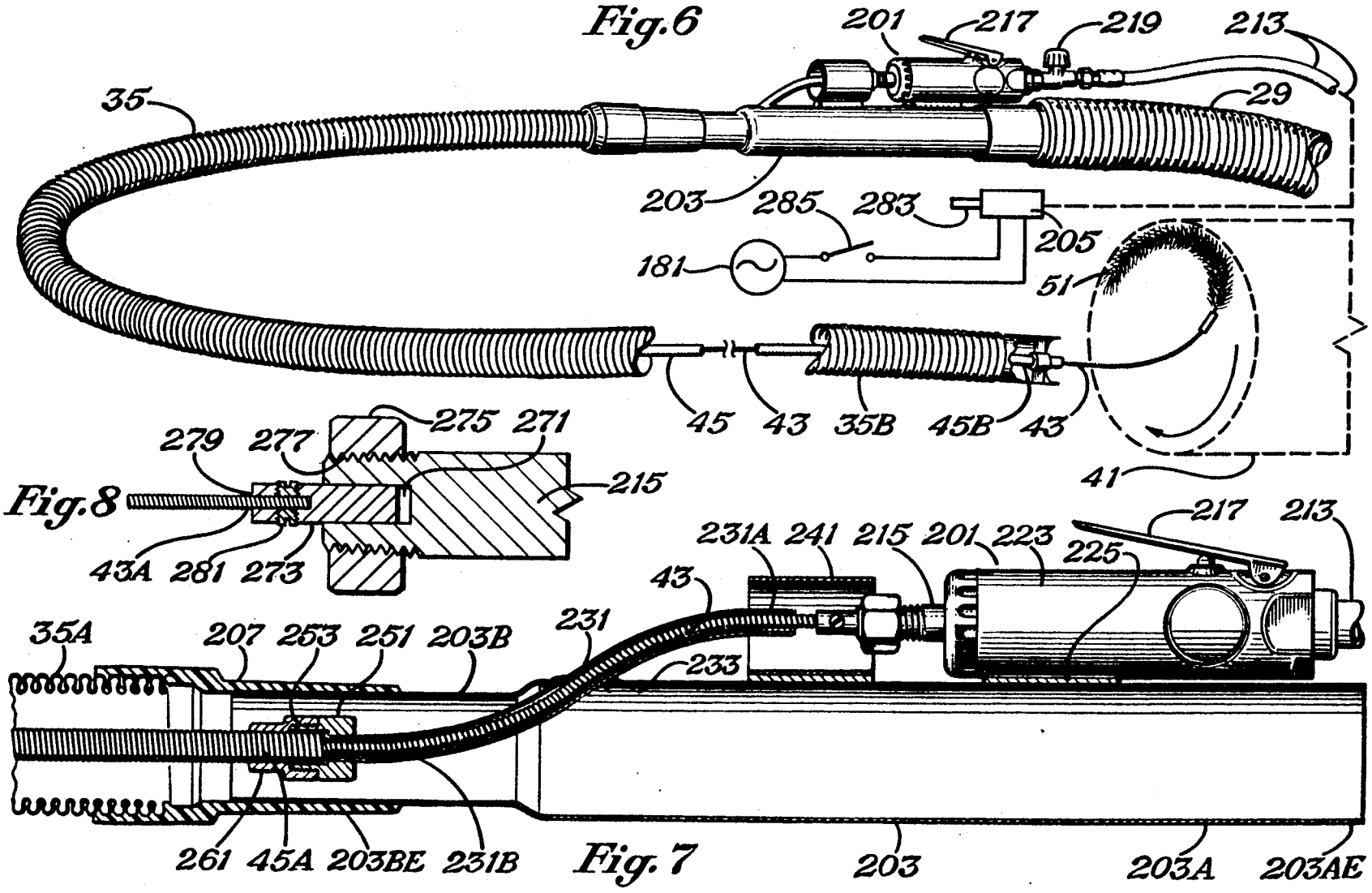
FIG. 6 illustrates another embodiment of the invention.
FIG. 7 is an enlarged cross-sectional view of the tubular support member of the apparatus of FIG. 6.
FIG. 8 is a cross-sectional view of the connection of the flexible drive shaft portion and the shaft of the air motor of FIG. 6.

The embodiment of FIGS. 1–5 has advantages as mentioned above, however sometimes the turbine 21 tends to be clogged with dust and other matter reducing its r.p.m. and effectiveness unless it is cleaned. Referring to FIGS. 6–8, there is disclosed an embodiment wherein a separate air motor 201 mounted on a tubular support member 203 is employed to rotate the flexible shaft 43 and hence the brush 51 in the duct to be cleaned. In FIGS. 6–8 like components are identified by like reference numerals employed in FIGS. 1–5. The vacuum source 31 is employed to draw a vacuum through the hose 35, the tubular support member 203, and the hose 29 to remove dust and other material loosened in the air duct by the brush 51. A separate source 205 of air under high pressure is employed to operate the air motor 201 to rotate the flexible drive shaft 43. The tubular support member 203 comprises a hollow metal tube having a larger diameter portion 203A and a smaller diameter portion 203B. The end of the hose 29A is fitted around the larger end 203AE of the tubular member 203. The end 35A of the hose 35 is connected to a tubular attachment member 207 which is fitted around the smaller end 203BE of the tubular member 203. The air motor 201 is a commercially available motor having an inlet hose 213 connected thereto through which air is injected for rotating a shaft 215. Member 217 is a hand throttle which controls the rotational speed of the shaft 215 of the air motor 201. Member 219 is an air regulator employed to control the maximum rotational speed of the air motor 201. The outlet of the air motor is not shown. The outer wall 223 of the air motor 201 has a plate 225 connected thereto which is welded to the exterior of the tubular support member 203. An S-shaped metal tubular member 231 extends through an aperture 233 formed through the tubular support member 203 and is welded thereto. The exterior end 231A of member 231 extends into a hollow tubular member 241 which is welded to the tubular support member 203. The interior end 231B of member 231 extends to the interior of the smaller diameter portion 203B of the tubular support member 203 and is fitted into and connected to the inside wall of an aperture formed through a member 251 which has male threads 253 formed at one end thereof. The outer sleeve 45 of the flexible drive shaft has its end 45A connected to a hollow member 261 having female threads which are screwed to the threads 253 of the member 251 to fixedly attach the outer sleeve 45 to the S-shaped tubular member 231. The flexible drive shaft 43 extends through the S-shaped tube 231 and is connected to the shaft 215 of the air motor 203. As seen in FIG. 8, the shaft 215 has a central aperture 271 formed in its end into which is inserted a rod 273 and which is held in place by a nut 275 screwed to the threads 277 of the shaft 215. The rod 273 has a central aperture 279 formed therein into which is inserted the end 43A of the flexible drive shaft 43. Set screws 281 are screwed into threaded apertures formed into the rod 273 to secure the end 43A of the flexible drive shaft 43 to the rod 273 and hence to the shaft 215 for rotation therewith. The other end 45B of the outer sleeve 45 of the flexible drive shaft is secured to the end 35B of the flexible hose 35 in the same manner as described in conjunction with FIG. 3.

In the operation of the apparatus of FIGS. 6–8, the high pressure air source 205 is operated to apply high pressure air to the motor 201 to rotate its shaft 215 to cause the flexible drive shaft 43 and hence the brush 51 to rotate. At the same time, the vacuum source 31 is operated to move air through the flexible hose 35, the tubular support member 203, and the hose 29 to remove dust or other material from the duct which has been loosened by the brush 51. With the arrangement of the apparatus of FIGS. 6–8, dust or other material cannot affect the drive for the flexible drive shaft 43 or the vacuum flow path through the flexible hoses.

In one embodiment, the source 205 an electrically operated air compressor operated at 90 PSI and 3 CFM of air. Member 283 is an air inlet. The source 205 is operated by closing switch 285 for applying AC voltage from source 181 to the motor of the air compressor.

The air motor 201 may be the type manufactured by Grainger, having a place of business at Grand Prairie, Tex., identified as model 2Z491. The air motor 201 operates at 90 psi of air pressure and 3 cfm of air.

In the alternative, the air motor 201 may be formed in a manner similar to that of the turbine 23 with a separate air source is employed to operate the air motor to drive its shaft and hence the flexible drive shaft 43.

I claim:

1. A cleaning apparatus, comprising:

flexible hose means having first and second ends with said second end being insertable into a duct for cleaning purposes, said flexible hose means providing a flow path for the flow of air between said second end of said flexible hose means and said first end of said flexible hose means, air driven motor means having a shaft means which is rotatable upon operation of said air driven motor means, conduit means coupled to said air driven motor means, said conduit means providing a flow path to said air driven motor means separate from said flexible hose means for supplying air under pressure to said air driven motor means for operating said air driven motor means, a flexible drive shaft extending at least partially through said flexible hose means and having a first end coupled to said shaft means and a second end extending out of said second end of said flexible hose means for rotation with said shaft means, and brush means coupled to said second end of said flexible drive shaft for rotation therewith for cleaning the wall of the duct upon rotation of said flexible drive shaft.

2. The cleaning apparatus of claim 1, comprising:

means coupled to said first end of said flexible hose means for reducing the pressure within said flexible hose means for causing air to flow through said flexible hose means for removing matter loosened in the duct by said brush means, and a high pressure air source for applying air under high pressure, by way of said conduit means, to said air driven motor means for operating said air driven motor means for rotating said shaft means.

3. The cleaning apparatus of claim 1, comprising:

a tubular support member coupled to said first end of said flexible hose means, said air driven motor means being mounted to said tubular support member, said flexible drive shaft means extends from said shaft means through the wall of said tubular support member to the interior of said flexible hose means.

4. The cleaning apparatus of claim 3, comprising:

means coupled to said first end of said flexible hose means for reducing the pressure within said flexible hose means for causing air to flow through said flexible hose means for removing matter loosened in the duct by said brush means, and a high pressure air source for applying air under high pressure, by way of said conduit means, to said air driven motor means for operating said air driven motor means for rotating said shaft means.

5. The cleaning apparatus of claim 1, wherein:

said air driven motor means is spaced from said second end of said flexible hose means.

6. The cleaning apparatus of claim 1, wherein:

said air driven motor means is located outside of said flexible hose means and said flexible drive shaft extends from said shaft means into the interior of said flexible hose means.

7. The cleaning apparatus of claim 6, wherein:

said air driven motor means is spaced from said second end of said flexible hose means.

8. The cleaning apparatus of claim 7, comprising:

means coupled to said first end of said flexible hose means for reducing the pressure within said flexible hose means for causing air to flow through said flexible hose means for removing matter loosened in the duct by said brush means, and a high pressure air source for applying air under high pressure, by way of said conduit means, to said air driven motor means for operating said air driven motor means by way of for rotating said shaft means.

9. The cleaning apparatus of claim 6, comprising:

means coupled to said first end of said flexible hose means for reducing the pressure within said flexible hose means for causing air to flow through said flexible hose means for removing matter loosened in the duct by said brush means, and a high pressure air source for applying air under high pressure, by way of said conduit means, to said air driven motor means for operating said air driven motor means for rotating said shaft means.

10. A cleaning apparatus, comprising:

flexible hose means comprising wall means and having first and second ends with second end being insertable into a duct for cleaning purposes, said flexible hose means providing a flow path for the flow of air between said second end of said flexible hose means and said first end of said flexible hose means, air driven motor means having a shaft means which is rotatable upon operation of said air driven motor means, said air driven motor means being located outside of said flexible hose means, a flexible drive shaft extending through said wall means and having a first end coupled to said shaft means and a second end extending out of said second end of said flexible hose means for rotation with said shaft means, and, brush means coupled to said second end of said flexible drive shaft for rotation therewith for cleaning the wall of the duct upon rotation of said flexible drive shaft.

11. The cleaning apparatus of claim 10, comprising:

means coupled to said first end of said flexible hose means for reducing the pressure within said flexible hose means for causing air to flow through said flexible hose means for removing matter loosened in the duct by said brush means, and a high pressure air source for applying air under high pressure, by way of said conduit means, to said air driven motor means for operating said air driven motor for rotating said shaft means.

12. The cleaning apparatus of claim 10, wherein:

said air driven motor means is spaced from said second end of said flexible hose means.

13. The cleaning apparatus of claim 12, comprising:

means coupled to said first end of said flexible hose means for reducing the pressure within said flexible hose means for causing air to flow through said flexible hose means for removing matter loosened in the duct by said brush means, and a high pressure air source for applying air under high pressure, by way of said conduit means, to said air driven motor means for operating said air driven motor means for rotating said shaft means.

* * * * *